US005223048A

United States Patent [19]

Inokuti

[11] Patent Number: 5,223,048

[45] Date of Patent: Jun. 29, 1993

[54] LOW IRON LOSS GRAIN ORIENTED SILICON STEEL SHEETS AND METHOD OF PRODUCING THE SAME

[75] Inventor: Yukio Inokuti, Chiba, Japan

[73] Assignee: Kawasaki Steel Corporation, Japan

[21] Appl. No.: 636,913

[22] Filed: Jan. 2, 1991

Related U.S. Application Data

[62] Division of Ser. No. 423,851, Oct. 18, 1989, Pat. No. 5,146,063.

[30] Foreign Application Priority Data

Oct. 26, 1988 [JP] Japan ..... 63-268316
Feb. 8, 1989 [JP] Japan ..... 1-27578

[51] Int. Cl.[5] ..... H01F 1/04

[52] U.S. Cl. ..... 148/307; 148/308; 420/117

[58] Field of Search ..... 148/306, 307, 308; 420/117

[56] References Cited

U.S. PATENT DOCUMENTS

| | | | |
|---|---|---|---|
| 4,203,784 | 5/1980 | Kuroki et al. | 148/111 |
| 4,533,409 | 8/1985 | Benford | 148/111 |
| 4,548,656 | 10/1985 | Kimoto et al. | 148/111 |
| 4,770,720 | 9/1988 | Kobayashi et al. | 148/111 |
| 4,909,864 | 3/1990 | Inokuti et al. | 148/113 |
| 4,960,652 | 10/1990 | Wada et al. | 148/307 |

*Primary Examiner*—John P. Sheehan
*Attorney, Agent, or Firm*—Austin R. Miller

[57] ABSTRACT

In grain oriented silicon steel sheets provided with surface layer after finish annealing, microareas of the surface layer are locally pushed into at least an inside of base metal through electron beam irradiation in a direction substantially perpendicular to the rolling direction of the sheet, whereby iron loss of the sheet is considerably reduced.

5 Claims, 6 Drawing Sheets

LOW IRON LOSS GRAIN ORIENTED SILICON STEEL SHEETS AND METHOD OF PRODUCING THE SAME

This is a division of application Ser .No. 423,851, filed Oct. 18, 1989 now U.S. Pat. No. 5,146,063.

BACKGROUND OF THE INVENTION

1. Field of the Invention

This invention relates to low iron loss grain oriented silicon steel sheets and a method of producing the same, and more particularly to grain oriented silicon steel sheets having an iron loss considerably reduced by locally pushing a surface layer of the steel sheet into a base metal to conduct refinement of magnetic domains.

2. Related Art Statement

The grain oriented silicon steel sheets are manufactured through complicated and many steps requiring severe controls, wherein secondary recrystallized grains are highly aligned in Goss orientation, and a forsterite layer is formed on a surface of base metal for steel sheet and further an insulative layer having a small thermal expansion coefficient is formed thereon.

Such a grain oriented silicon steel sheet is mainly used as a core for transformer and other electrical machinery and equipment. In this case, it is required that the magnetic flux density (represented by $B_{10}$ value) is high and the iron loss (represented by $W_{17/50}$ value) is low as magnetic properties, and the insulative layer having good surface properties is provided.

Particularly, supreme demands on the reduction of power loss become conspicuous in view of energy-saving, so that the necessity of grain oriented silicon steel sheets having a lower iron loss as a core for the transformer becomes more important.

It is no exaggeration to say that the history of reducing the iron loss of the grain oriented silicon steel sheet is a history of improving secondary recrystallization structure of Goss orientation. As a method of controlling such a secondary recrystallized grain, there is practiced a method of preferentially growing the secondary recrystallized grains of Goss orientation by using an agent for controlling growth of primary crystallized grain such as AlN, MnS, MnSe or the like, or a so-called inhibitor.

On the other hand, different from the above method of controlling the secondary recrystallization structure, there are proposed epock-making methods, wherein local microstrains are introduced by irradiating laser onto a steel sheet surface {see T. Ichiyama: Tetsu To Hagane, 69(1983), p 895, Japanese Patent Application Publication No. 57-2252, No. 57-53419, No. 58-24605 and No. 58-24606) or by plasma irradiation (see Japanese Patent laid open No. 62-96617, No. 62-151511, No. 62-151516 and No. 62-151517) to refine magnetic domains to thereby reduce the iron loss. In the steel sheets obtained by these methods, however, the microstrain is disappeared through the heating upto a high temperature region, so that these sheets can not be used as a material for wound-core type transformers which are subjected to strain relief annealing at high temperature.

Furthermore, there is proposed a method of causing no degradation of iron loss property even when being subjected to strain relief annealing at high temperature. For example, there are a method of forming groove or serration on a surface of a finish annealed sheet (see Japanese patent Application Publication No. 50-35679 and Japanese Patent laid open No. 59-28525 and No. 59-197520), a method of producing fine regions of recrystallized grains on the surface of the finish annealed sheet (see Japanese Patent laid open No. 56-130454), a method of forming different thickness regions or deficient regions in the forsterite layer (see Japanese Patent laid open No. 60-92479, No. 60-92480, No. 60-92481 and No. 60-258479), a method of forming different composition regions in the base metal, forsterite layer or tension insulative layer (Japanese Patent laid open No. 60-103124 and No. 60-103182), and the like.

In these methods, however, the steps become complicated, and the effect of reducing the iron loss is less, and the production cost is high, so that such methods are not yet adopted industrially.

SUMMARY OF THE INVENTION

It is, therefore, an object of the invention to provide low iron loss grain oriented silicon steel sheets stably produced without degrading iron loss reduced by magnetic domain refinement even through strain relief annealing as well as a method of advantageously producing the same.

According to a first aspect of the invention, the low iron loss grain oriented silicon steel sheet after finish annealing is provided with a forsterite layer or further with an insulative layer formed thereon, wherein microareas of the forsterite layer or the forsterite layer and insulative layer pushed into base metal without fracture are locally introduced into the surface of the steel sheet in a direction substantially perpendicular to the rolling direction of the steel sheet.

Here, the term "grain oriented silicon steel sheet after finish annealing" used herein means silicon steel sheets obtained by heating and hot rolling a silicon steel slab to form a hot rolled sheet, subjecting the hot rolled sheet to cold rolling two times through an intermediate annealing to form a final cold rolled sheet, subjecting the cold rolled sheet to decarburization and primary recrystallization annealing, applying a slurry of an annealing separator consisting mainly of MgO, and then subjecting to secondary recrystallization annealing for the preferential growth of secondary recrystallized grains in Goss orientation and purification annealing. Moreover, the term "finish annealing" means a combination of secondary recrystallization annealing step and purification annealing step.

Preferably, the microarea is advantageous to extend from the front surface of the sheet through base metal to the surface layer located at the rear surface of the sheet. In the latter case, micro-convex area is formed on the rear surface of the sheet at a position corresponding to the pushed area of the front surface of the sheet.

According to a second aspect of the invention, the low iron loss grain oriented silicon steel sheets are advantageously produced by locally irradiating electron beam generated at high voltage and low current as compared with the usual welding device of low voltage and high current to the surface of the grain oriented silicon steel sheet after finish annealing provided with a forsterite layer or further with an insulative layer formed thereon in a direction substantially perpendicular to the rolling direction of the sheet, whereby the surface layer is pushed into at least an inside of base metal.

In a preferred embodiment of the second invention, the refinement of magnetic domains can be promoted by varying irradiation diameter and irradiation time of the electron beam to narrow the interval between the pushed microareas. In another preferred embodiment, the irradiation of electron beam is carried out by correcting a focusing distance of the electron beam at a proper distance so as to always locate at the surface of the sheet in accordance with the change of the distance from the electromagnetic lens to the sheet surface during the scanning of the electron beam.

BRIEF DESCRIPTION OF THE DRAWINGS

The invention will be described with reference to the accompanying drawings, wherein.

DESCRIPTION OF THE PREFERRED EMBODIMENTS

Figure 1A:
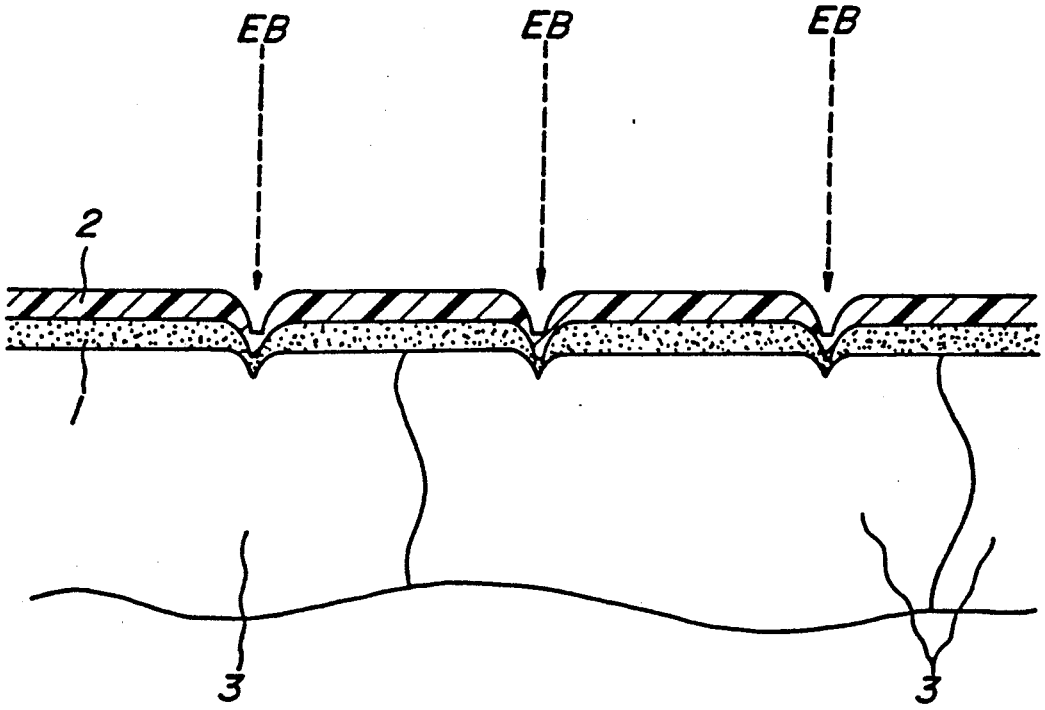
FIGS. 1*a* and 1*b* are diagrammatical views showing mechanism for the improvement of magnetic properties according to the invention, respectively.

The invention will be described with respect to experimental details resulting in the success of the invention.

A slab of silicon steel containing C: 0.043% by weight (hereinafter referred to as % simply), Si: 3.45%, Mn: 0.068%, Se: 0.022%, Sb: 0.025% and Mo: 0.013% was heated at 1380° C. for 4 hours and hot rolled to form a hot rolled sheet of 2.2 mm in thickness, which was then cold rolled two times through an intermediate annealing at 980° C. for 120 minutes to obtain a final cold rolled sheet of 0.20 mm in thickness. Next, the cold rolled sheet was subjected to decarburization and primary recrystallization annealing in a wet hydrogen atmosphere at 820° C., coated with a slurry of an annealing separator consisting mainly of MgO, subjected to secondary recrystallization annealing at 850° C. for 50 hours to preferentially grow the secondary recrystallized grains in Goss orientation and then subjected to purification annealing at 1200° C. in a dry hydrogen atmosphere for 5 hours to obtain a sample sheet (A). Furthermore, an insulative layer consisting mainly of phosphate and colloidal silica was formed on a part of the sample sheet (A) to obtain a sample sheet (B). Thereafter, the following treatments (1)–(4) were applied to each of the sample sheets (A) and (B), whereby microstrains or microareas were locally produced in a direction perpendicular to the rolling direction of the sheet at an interval of 8 mm.

(1) cutting with a knife;

(2) YAG laser irradiation (energy per spot: $4\times10^{-3}$ J, spot diameter: 0.15 mm, distance between spot centers: 0.3 mm, scanning interval: 8 mm);

(3) EB irradiation (acceleration voltage: 100 kV, current: 0.7 mA, spot diameter: 1.0 mm, distance between spot centers: 0.3 mm, scanning interval: 8 mm);

(4) EB irradiation (acceleration voltage: 100 kV, current: 3.0 mA, spot diameter: 0.15 mm, distance between spot centers: 0.3 mm, scanning interval: 8 mm).

Each of the above treated samples was subjected to strain relief annealing at 800° C. for 2 hours. The magnetic properties measured after the strain relief annealing are shown in the following Table 1.

For the comparison, the magnetic properties of non-treated sheet (no introduction of microarea, strain relief annealing) are also shown in Table 1.

TABLE 1

| Treatment | (A) Finish annealed sheet | (B) Formation of insulative layer on finish annealed sheet | Magnetic properties $B_{10}$ (T) | $W_{17/50}$ (W/kg) |
|---|---|---|---|---|
| (1) | ○ | — | 1.92 | 0.87 |
| | — | ○ | 1.91 | 0.86 |
| (2) | ○ | — | 1.92 | 0.85 |
| | — | ○ | 1.91 | 0.84 |
| (3) | ○ | — | 1.92 | 0.80 |
| | — | ○ | 1.92 | 0.79 |
| (4) | ○ | — | 1.92 | 0.79 |
| | — | ○ | 1.91 | 0.78 |
| Comparative sheet | ○ | — | 1.92 | 0.85 |
| | — | ○ | 1.91 | 0.86 |

As seen from Table 1, when each of the sample sheets (A) and (B) is subjected to each of the treatments (3) and (4), the iron loss value is improved by 0.05–0.08 W/kg as compared with those of the other cases.

In the sample sheets treated by the treatment (4), micro-convex areas were observed at the rear surface of the sheet, from which it is understood that the pushed microareas are introduced up to the rear surface of the sheet.

The reason why the iron loss value of the sample treated by the treatment (3) is improved as compared with those treated by the treatments (1) and (2) is due to the fact that as shown in FIG. 1*a*, microareas of forsterite layer 1 and insulative layer 2 pushed into base metal 3 (secondary recrystallized grains having a Goss orientation) in depthwise direction thereof act as a nucleus for effective refinement of magnetic domains eve when being subjected to strain relief annealing, whereby the magnetic domain refinement is made possible.

Figure 1B:
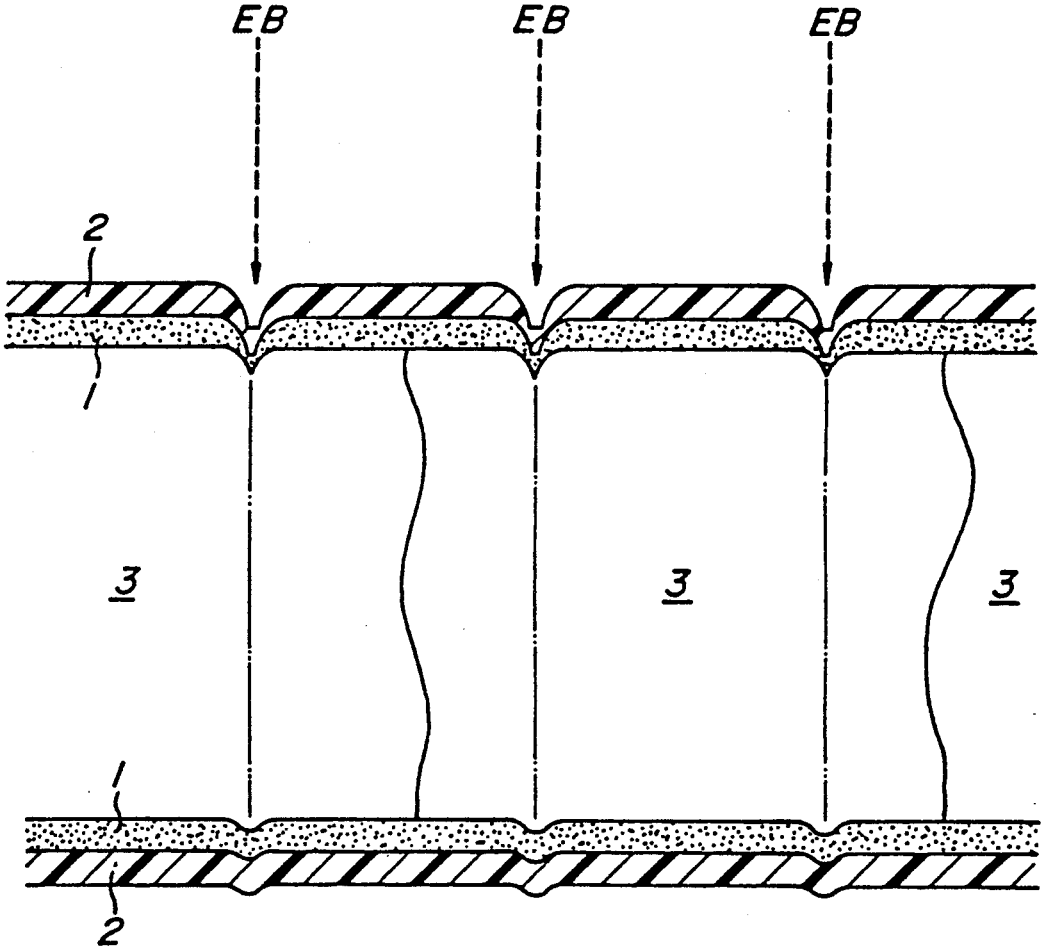

Further, the reason why the iron loss value of the sample treated by the treatment (4) is considerably improved as compared with those of the other samples is due to the fact that as shown in FIG. 1*b*, the pushed microareas are further penetrated in the base metal 3 to extend up to the rear surface of the sheet, which act as a strong nucleus for the magnetic domain refinement.

Figure 2:
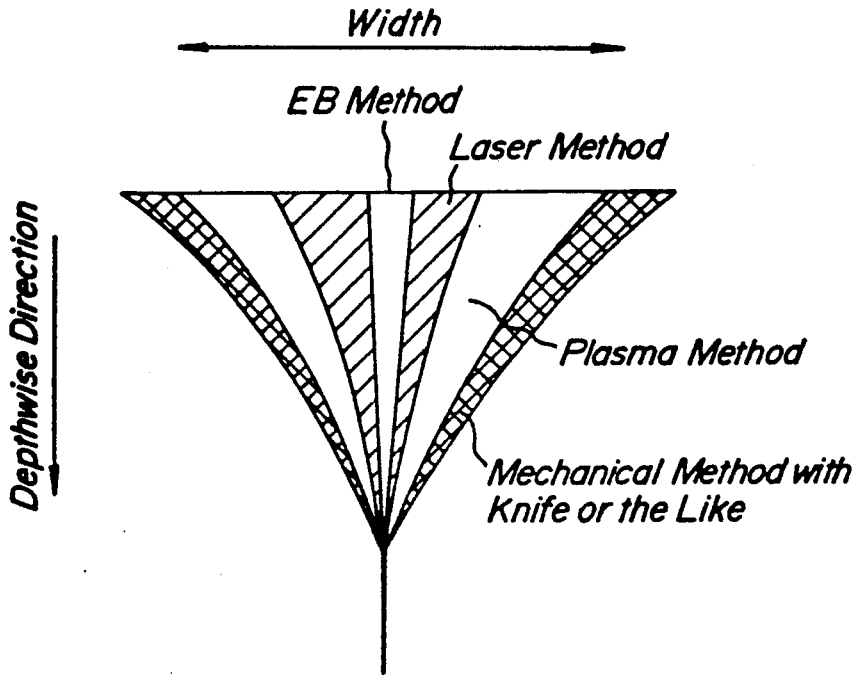
FIG. 2 is a diagrammatical view showing permeation force in depthwise direction and magnitude thereof in widthwise direction by various methods to the silicon steel sheet.

Moreover, the deep penetration of the microareas of the forsterite layer and insulative layer into the inside of the base metal in the widthwise direction of the sheet can be first achieved by using EB having a high voltage of 65–500 kV and a low current of 0.001–5 mA. As shown in FIG. 2, the use of high voltage and low current EB is strong in the permeation force in depthwise direction and narrow in the permeation width as compared with the other means (laser, plasma, mechanical means and the like), so that the forsterite layer and insulative layer can be pushed into the base metal without disappearance.

Then, EB irradiating conditions will be described with respect to the following experiment.

A slab of silicon steel containing C: 0.042%, Si: 3.42%, Mn: 0.072%, Se: 0.021%, Sb: 0.023% and Mo: 0.013% was heated at 1370° C. for 4 hours and hot rolled to form a hot rolled sheet of 2.2 mm in thickness, which was then cold rolled two times through an intermediate annealing at 980° C. for 120 minutes to obtain a final cold rolled sheet of 0.20 mm in thickness. After the cold rolled sheet was subjected to decarburization and primary recrystallization annealing at 820° C. in a wet hydrogen atmosphere, a slurry of an annealing separator consisting mainly of MgO was applied to the sheet surface and then the sheet was subjected to secondary recrystallization annealing at 850° C. for 50 hours to preferentially grow the secondary recrystallized grain in Goss orientation and then subjected to purification annealing at 1200° C. in a dry hydrogen atmosphere for 5 hours to obtain a sample sheet (C). Furthermore, an insulative layer consisting mainly of phosphate and colloidal silica was formed on a part of the sample sheet (C) to obtain a sample sheet (D). Thereafter, the following EB irradiation treatments (1)-(3) were applied to each of the sample sheets (C) and (D), whereby microareas were locally produced in a direction perpendicular to the rolling direction of the sheet at an interval of 8 mm.

(1) EB irradiation (acceleration voltage: 150 kV, current: 1.5 mA, spot diameter: 0.12 mm, distance between spot centers: 0.3 mm, scanning interval: 8 mm)

Figure 3A:
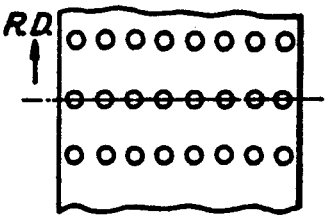
FIGS. 3*a*, 4*a* and 5*a* are schematic views showing electron beam (EB) irradiated tracks, respectively.
Figure 3B:
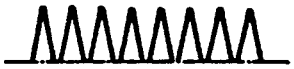
FIGS. 3*b*, 4*b* and 5*b* are views showing an intensity of EB, respectively.

As the EB irradiation to the steel sheet surface, the irradiated diameter of each spot and the irradiated distance between spots were made uniform as shown in FIG. 3*a*. Moreover, FIG. 3*b* shows an intensity of EB at each spot as a height of triangle.

(2) EB irradiation (acceleration voltage: 150 kV, current: 1.5 mA or 0.75 mA, spot diameter: 0.12 mm or 0.80 mm, distance between spot centers: 0.3 mm, scanning interval: 8 mm).

Figure 4A:
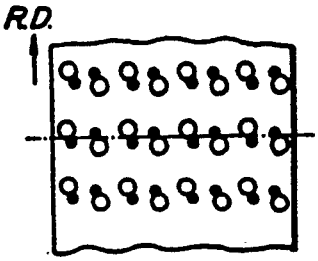
Figure 4B:
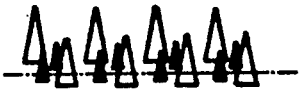

As the EB irradiation to the steel sheet surface, the irradiated tracks as shown in FIG. 4*a* were formed by alternately changing the current to 1.5 mA and 0.75 mA to change the irradiated diameter and the irradiated distance. Moreover, FIG. 4*b* shows an intensity of EB likewise FIG. 3*b*.

(3) EB irradiation (acceleration voltage: 150 kV, current: 1.5 mA or 0.75 mA, spot diameter: 0.12 mm or 0.80 mm, distance between spot centers: 0.3 mm, scanning interval: 8 mm).

Figure 5A:
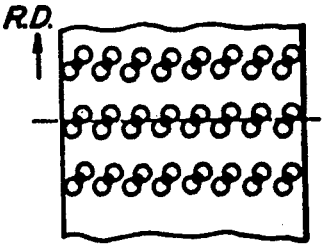
Figure 5B:
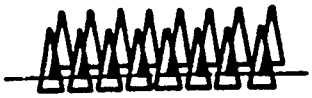

As the EB irradiation to the steel sheet surface, the irradiated tracks as shown in FIG. 5*a* were formed by changing the irradiated diameter and the irradiated distance with currents of 1.5 mA and 0.75 mA. Moreover, FIG. 5*b* shows an intensity of EB likewise FIG. 3*b*.

Each of the above treated samples was subjected to strain relief annealing at 800° C. for 2 hours. The magnetic properties measured after the strain relief annealing are shown in the following Table 2.

For the comparison, the magnetic properties of non-treated sheet (no introduction of microarea, strain relief annealing) are also shown in Table 2.

TABLE 2

| Treatment | (C) Finish annealed sheet | (D) Formation of insulative layer on finish annealed sheet | Magnetic properties $B_{10}$ (T) | Magnetic properties $W_{17/50}$ (W/kg) | Lamination factor (%) |
|---|---|---|---|---|---|
| (1) | ○ | — | 1.92 | 0.82 | 96.6 |
| | — | ○ | 1.91 | 0.83 | 96.7 |
| (2) | ○ | — | 1.92 | 0.78 | 96.7 |
| | — | ○ | 1.91 | 0.79 | 96.8 |
| (3) | ○ | — | 1.92 | 0.77 | 96.7 |
| | — | ○ | 1.91 | 0.78 | 96.8 |
| Comparative sheet | ○ | — | 1.92 | 0.88 | 96.7 |
| | — | ○ | 1.91 | 0.89 | 96.8 |

As seen from Table 2, in the sample sheets (C) and (D) treated through EB, the iron loss value is improved by 0.05–0.11 W/kg as compared with those of the comparative sheet. Particularly, the iron loss value in case of the EB irradiation treatments (2) and (3) is largely improved by 0.10–0.11 W/k). Furthermore, the products have a good lamination factor of 96.6–96.8%.

Further, it has been found that the permeation force of EB in the thickness direction (depthwise direction) of the silicon steel sheet increases at an acceleration voltage of not less than 65 kV usually generating a great amount of X-ray. In general, the acceleration voltage usually used for welding is not more than 60 kV, so that the permeation force is very small. That is, the above effect found out in the invention can not be found and utilized at such a conventional acceleration voltage. In order to utilize the effect of the invention at maximum, therefore, it is important to set the acceleration voltage to a high value (65–500 kV) and the acceleration current to a small value (0.001–5 mA), whereby the permeation force in the thickness direction of the silicon steel sheet can be increased without causing the breakage of the forsterite layer and insulative layer. Further, in order to efficiently conduct the magnetic domain refinement, it is favorable that the diameter of the irradiated area is rendered into 0.005–0.3 mm by using a fine EB. And also, it is preferable that the direction of scanning EB is substantially perpendicular to the rolling direction of the sheet, preferably an angle of 60°–90° with respect to the rolling direction, and the distance between spot centers is 0.005–0.5 mm, and the scanning interval is 2–20 mm, and the irradiation time per spot is 5–500 μsec. Moreover, the insulating property on the EB irradiated tracks may be enhanced by forming the insulative layer after the EB irradiation, but in this case the cost is increased. In general, the satisfactory insulating effect ca be developed without the formation of insulative layer after EB irradiation.

The silicon steel sheets according to the invention may be used as a material for stacked lamination-core type transformers and wound-core type transformers as previously mentioned. In case of the stacked lamination-core type transformer, the introduction of microarea having a smaller spot diameter is required as compared with the wound-core type transformer. For this purpose, it is favorable that the current is small and the scanning interval is wide as EB irradiating conditions. In case of the wound-core type transformer, it is favorable that the current is somewhat large and the scanning interval is narrow as the EB irradiating conditions for promoting the introduction of microarea. Moreover, EB may be irradiated to one-side surface or both-side surfaces of the silicon steel sheet.

Figure 6:
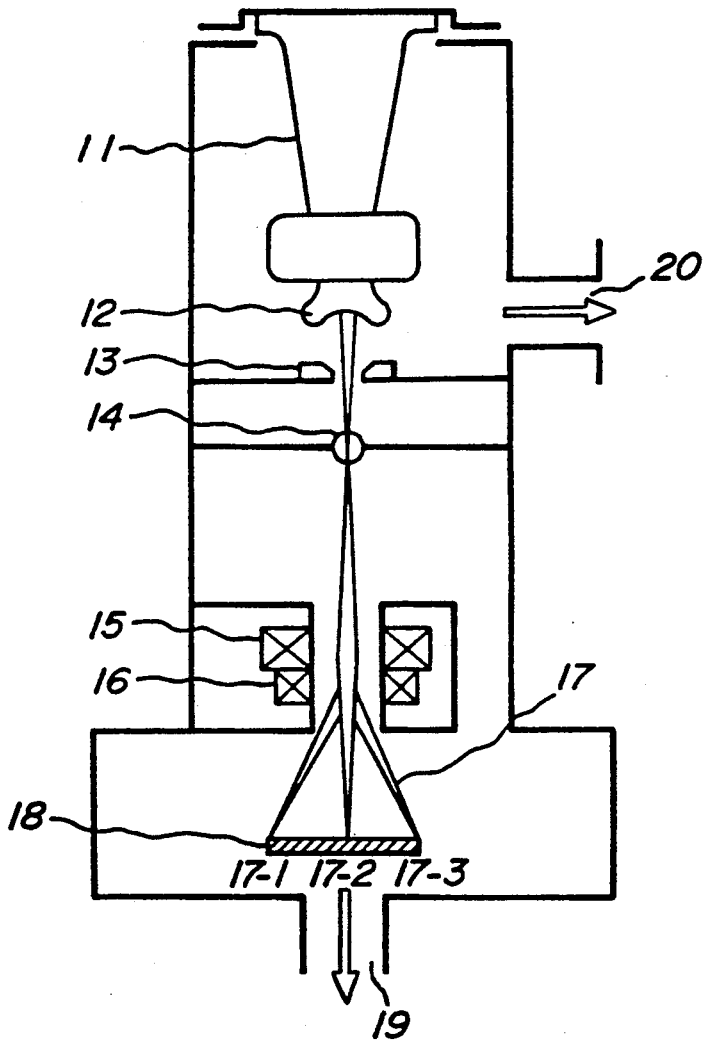
FIG. 6 is a diagrammatical view of EB irradiation apparatus usable for carrying out the invention.
Figure 7A:
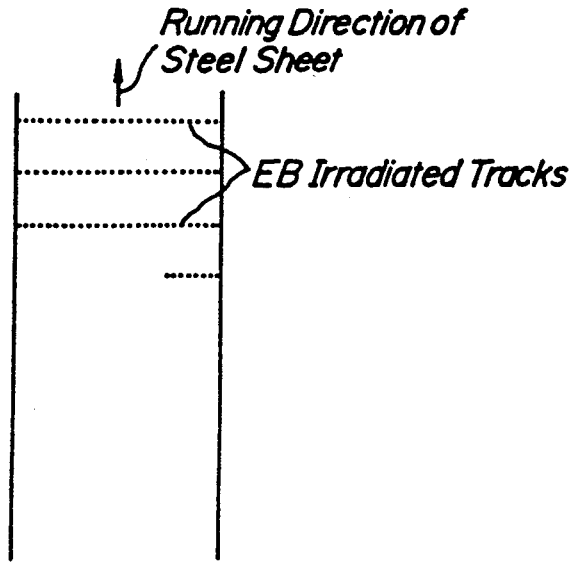
FIG. 7*a* is a schematic view showing EB irradiated tracks on the sheet surface.
Figure 7B:
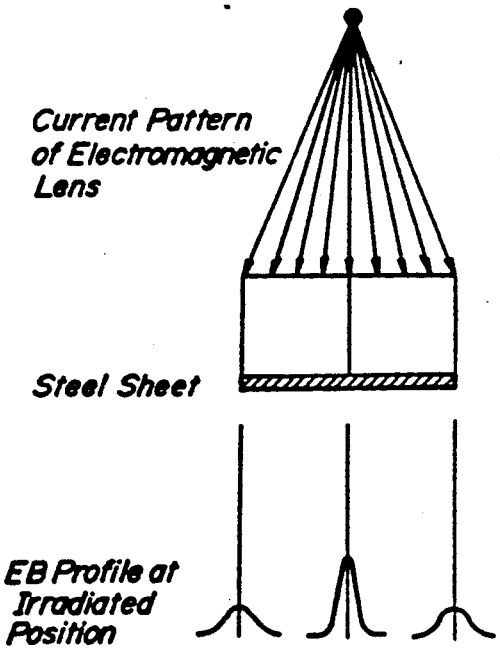
FIGS. 7*b* and 7*c* are views showing intensity of EB in the widthwise direction of the sheet during the scanning of EB by various methods, respectively.
Figure 7C:
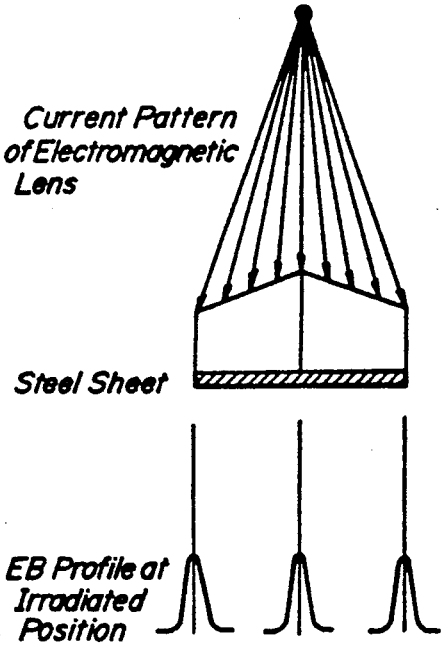

In FIG. 6 is schematically shown a preferable embodiment of the EB irradiation apparatus suitable for practicing the invention, wherein 11 is a high voltage insulator, 12 an EB gun, 13 an anode, 14 a column valve, 15 an electromagnetic lens, 16 a deflecting coil, 17 an EB, 18 a grain oriented silicon steel sheet and 19 and 20 discharge ports, respectively.

In general, the EB irradiation to the steel sheet surface is carried out in a direction substantially perpendicular to the rolling direction of the sheet as shown in FIG. *7a*. In this case, since the current of the electromagnetic lens (focusing current) is constant, when the focus of the electromagnetic lens is met with the center of the sheet in the widthwise direction, the EB intensity is strongest at the central portion (17-2') of the sheet in the widthwise direction thereof and becomes weak at both end portions (17-1', 17-3') of the sheet as shown in FIG. *7b* because when the focusing position of EB locates on the steel sheet surface, the pushing into the sheet is carried out most effectively.

In the preferred embodiment of EB irradiation according to the invention, the focusing distance of EB is corrected in accordance with the change of the distance between electromagnetic lens and the sheet during the EB scanning so as to always meet the focusing position with the sheet surface over the widthwise direction thereof. Such a correction of the focusing distance can be accurately carried out by dynamically controlling the currents of the electromagnetic lens 15 and the deflecting coil 16 shown in FIG. 6, whereby the EB scanning can be conducted at the same EB intensity over the full width of the sheet as shown in FIG. *7c*. Such a treatment is called as a dynamic focusing hereinafter.

In this connection, the invention will be described with respect to the following experiment.

A slab of silicon steel containing C: 0.043%, Si: 3.39%, Mn: 0.066%, Se: 0.020%, Sb: 0.023% and Mo: 0.015% was heated at 1360° C. for 4 hours and hot rolled to form a hot rolled sheet of 2.0 mm in thickness, which was then subjected to a normalized annealing at 950° C. for 3 minutes and further cold rolled two times through an intermediate annealing at 950° C. for 3 minutes to obtain a final cold rolled sheet of 0.20 mm in thickness.

After the cold rolled sheet was subjected to decarburization and primary recrystallization annealing at 820° C. in a wet hydrogen atmosphere, a slurry of an annealing separator consisting mainly of MgO was applied to the sheet surface, and then the sheet was subjected to finish annealing.

After an insulative layer consisting mainly of phosphate and colloidal silica was formed on the sheet surface, the sheet was subjected to usual EB irradiation (a-1) or EB irradiation through dynamic focusing (a-2). For the comparison, there was provided the sheet not subjected to EB irradiation (a-3).

On the other hand, a slurry of an annealing separator consisting mainly of $Al_2O_3$ was applied to the sheet surface after the above primary recrystallization annealing, which was subjected to finish annealing under the same conditions as mentioned above. Thereafter, the finish annealed sheet was lightly pickled and subjected to an electrolytic polishing into a mirror surface having a center-line average roughness of Ra=0.1 μm, on which a thin layer of TiN having a thickness of 1.0 μm was formed by an ion plating apparatus through HCD method (acceleration voltage: 70 V, acceleration current: 1000 A, vacuum degree: $7\times10^{-4}$ Torr). Then, the sheet was subjected to usual EB irradiation (b-1) or EB irradiation through dynamic focusing (b-2) and an insulative layer consisting mainly of phosphate and colloidal silica was formed thereon.

Moreover, an insulative layer consisting mainly of phosphate and colloidal silica was formed on a part of the sheet provided with the TiN thin layer, which was subjected to usual EB irradiation (b-3) or EB irradiation through dynamic focusing (b-4).

For the comparison, there was provided the sheet provided with the insulative layer but not subjected to EB irradiation treatment (b-5).

The magnetic properties of each of the thus obtained products are shown in the following Table 3.

TABLE 3

| Treatment | Sample | EB irradiation method | Magnetic properties $B_{10}$ (T) | Magnetic properties $W_{17/50}$ (W/kg) |
|---|---|---|---|---|
| a-1 | Finish annealed sheet | 1 usual EB irradiation* | 1.90 | 0.82 |
| a-2 | | 2 EB irradiation through dynamic focusing** | 1.91<br>1.91 | 0.78<br>0.78 |
| a-3 | | 3 — | 1.90 | 0.85 |
| b-1 | Sheet provided at its surface with TiN layer after mirror polishing of finish annealed sheet | 1 usual EB irradiation* | 1.92 | 0.66 |
| b-2 | | 2 EB irradiation through dynamic focusing** | 1.93 | 0.63 |
| b-3 | | 1 usual EB irradiation* | 1.92 | 0.67 |
| b-4 | | 2 EB irradiation through dynamic focusing** | 1.93 | 0.64 |
| b-5 | | 3 — | 1.92 | 0.70 |

* 1 usual EB irradiation: acceleration voltage: 70 kV, acceleration current: 7 mA, scanning interval in a direction perpendicular to rolling direction: 300 μm, scanning width: 10 mm.

** 2 EB irradiation through dynamic focusing: acceleration voltage: 70 kV, acceleration current: 7 mA, scanning interval in a direction perpendicular to rolling direction: 300 μm, scanning width: 10 mm, dynamic focusing of electromagnetic lens and deflecting coil.

As seen from Table 3, when the sheet is subjected to EB irradiation through dynamic focusing, the iron loss property is further improved as compared with the case of conducting the usual EB irradiation.

Thus, the further reduction of iron loss can be attained by adopting the dynamic focusing in the widthwise direction of the sheet when the sheet provided with the insulative layer after the finish annealing of the grain oriented silicon steel sheet is subjected to EB irradiation or the sheet provided with TiN layer after the mirror polishing of the finish annealed sheet is subjected to EB irradiation before or after the formation of the insulative layer. That is, in case of the dynamic focusing, the focusing distance of the electron beam is corrected so as to always locate at the sheet surface in accordance with the change of the focusing position during the EB scanning as shown in FIG. *7c*, whereby constant irradiated tracks are formed over the widthwise direction of the sheet to effectively conduct the refinement of magnetic domains over the whole area of the sheet, and consequently low iron loss silicon steel sheets can be obtained.

The following examples are given in illustration of the invention and are not intended as limitations thereof.

EXAMPLE 1

A slab of each of (A) silicon steel containing C: 0.043%, Si: 3.36%, Se: 0.02%, Sb: 0.025% and Mo: 0.013% and (B) silicon steel containing C: 0.063%, Si: 3.42%, Al: 0.025%, S: 0.023%, Cu: 0.05% and Sn: 0.1% was heated at 1380° C. for 4 hours and hot rolled to obtain a hot rolled sheet of 2.2 mm in thickness, which was then cold rolled two times through an intermediate annealing at 980° C. for 120 minutes to obtain a final cold rolled sheet of 0.20 mm in thickness. After the cold rolled sheet was subjected to decarburization and primary recrystallization annealing at 820° C. in a wet hydrogen atmosphere, a slurry of an annealing separator consisting mainly of MgO was applied to the surface of the sheet, which was then subjected to a finish annealing, wherein secondary recrystallization annealing was carried out at 850° C. for 50 hours to preferentially grow secondary recrystallized grains in Goss orientation and purification annealing was carried out at 1200° C. in a dry hydrogen atmosphere for 5 hours, whereby a finish annealed sheet (thickness: 0.20 mm) provided with a forsterite layer was obtained. Further, a part of the sheet was provided at its surface with an insulative layer.

These sheets were subjected to EB irradiation in a direction perpendicular to the rolling direction of the sheet by means of EB irradiation apparatus under conditions that acceleration voltage was 100 kV, acceleration current was 0.5 mA, spot diameter was 0.1 mm, distance between spot centers was 0.3 mm and scanning interval was 8 mm, provided that the microareas pushed did not reach to the layers at the rear surface of the sheet.

After the sheet was subjected to strain relief annealing at 800° C. for 2 hours, the magnetic properties were measured to obtain results as shown in the following Table 4 together with those of the comparative sheet (no introduction of microarea, strain relief annealing). As seen from Table 4, the iron loss $W_{17/50}$ is reduced by 0.08–0.1 W/kg as compared with that of the comparative sheet.

TABLE 4

| Sample | Finish annealed | Insulative layer formed on finish annealed sheet | Magnetic properties $B_{10}$ (T) | Magnetic properties $W_{17/50}$ (W/kg) | EB irradiation |
|---|---|---|---|---|---|
| (A) | ○ | — | 1.92 | 0.79 | irradiated |
| | — | ○ | 1.91 | 0.77 | |
| (B) | ○ | — | 1.94 | 0.78 | |
| | — | ○ | 1.93 | 0.76 | |
| Comparative sheet | ○ | — | 1.92 | 0.86 | not irradiated |
| | — | ○ | 1.91 | 0.87 | |

EXAMPLE 2

A slab of each of (A) silicon steel containing C: 0.042%, Si: 3.38%, Se: 0.023%, Sb: 0.026% and Mo: 0.012% and (B) silicon steel containing C: 0.061%, Si: 3.44%, Al: 0.026%, S: 0.028%, Cu: 0.08% and Sn: 0.15% was treated by the same manner as in Example 1 to obtain a finish annealed sheet (thickness: 0.20 mm) provided with a forsterite layer. Further, a part of the sheet was provided at its surface with an insulative layer.

These sheets were subjected to EB irradiation according to the scanning shown in FIG. 5 in a direction perpendicular to the rolling direction of the sheet by means of EB irradiation apparatus under conditions that acceleration voltage was 150 kV, acceleration current was 1.5 mA, spot diameter was 0.1 mm or 0.7 mm, distance between spot centers was 0.3 mm and scanning interval was 8 mm, provided that the microareas pushed reached to the layers at the rear surface of the sheet.

After the sheet was subjected to strain relief annealing at 800° C. for 2 hours, the magnetic properties were measured to obtain results as shown in the following Table 5 together with those of the comparative sheet (no introduction of microarea, strain relief annealing). As seen from Table 5, the iron loss $W_{17/50}$ is reduced by 0.10–0.14 W/kg as compared with that of the comparative sheet.

TABLE 5

| Sample | Finish annealed | Insulative layer formed on finish annealed sheet | Magnetic properties $B_{10}$ (T) | Magnetic properties $W_{17/50}$ (W/kg) | EB irradiation |
|---|---|---|---|---|---|
| (A) | ○ | — | 1.92 | 0.78 | irradiated |
| | — | ○ | 1.91 | 0.76 | |
| (B) | ○ | — | 1.94 | 0.77 | |
| | — | ○ | 1.93 | 0.75 | |
| Comparative sheet | ○ | — | 1.92 | 0.88 | not irradiated |
| | — | ○ | 1.91 | 0.89 | |

EXAMPLE 3

A slab of each of (A) silicon steel containing C: 0.040%, Si: 3.45%, Se: 0.025%, Sb: 0.030% and Mo: 0.015% and (B) silicon steel containing C: 0.057%, Si: 3.42%, sol Al: 0.026%, S: 0.029%, Cu: 0.1% and Sn: 0.050% was heated at 1380° C. for 4 hours and hot rolled to obtain a hot rolled sheet of 2.2 mm in thickness, which was then cold rolled two times through an intermediate annealing at 1050° C. for 2 minutes to obtain a final cold rolled sheet of 0.20 mm in thickness. After the cold rolled sheet was subjected to decarburization and primary recrystallization annealing at 840° C. in a wet hydrogen atmosphere, a slurry of (a) an annealing separator consisting mainly of MgO or (b) an annealing separator consisting of $Al_2O_3$: 60%, MgO: 35%, $ZrO_2$: 3% and $TiO_2$: 2% was applied to the surface of the sheet.

After the application of the annealing separator (a), the sheet (A) was subjected to secondary recrystallization annealing at 850° C. for 50 hours and further to purification annealing at 1200° C. in a dry hydrogen atmosphere for 5 hours, while the sheet (B) was subjected to secondary recrystallization annealing by heating from 850° C. to 1050° C. at a rate of 10° C./hr and further to purification annealing at 1220° C. in a dry hydrogen atmosphere for 8 hours.

Then, an insulative layer consisting mainly of phosphate and colloidal silica was formed on the surface of each of these sheets.

On the other hand, each of the sheets after the application of the annealing separator (b) wa pickled to remove oxides from the surface and subjected to electrolytic polishing into a mirror state, on which was formed a TiN tension layer of 1.0 μm in thickness by means of an ion plating apparatus and further the same insulative layer as mentioned above was formed thereon.

Thereafter, each of these sheets was subjected to EB irradiation through dynamic focusing by means of the apparatus shown in FIG. 6 at an interval of 8 mm in a direction perpendicular to the rolling direction of the sheet under conditions that acceleration voltage was 70 kV, current was 10 mA and scanning interval was 200 μm. Then, the magnetic properties were measured to obtain results (average values in the widthwise direction of the sheet) as shown in the following Table 6.

TABLE 6

| Kind of steel | Annealing separator | Surface layer | Magnetic properties $B_{10}$ (T) | $W_{17/50}$ (W/kg) |
|---|---|---|---|---|
| A | a | only insulative layer | 1.91 | 0.78 |
| | b | TiN + insulative layer | 1.93 | 0.63 |
| B | a | only insulative layer | 1.93 | 0.79 |
| | b | TiN + insulative layer | 1.94 | 0.64 |

As mentioned above, the invention provides grain oriented silicon steel sheets not degrading iron loss property even through strain relief annealing and a method of stably producing the same.

What is claimed is:

1. A low iron loss grain oriented silicon steel sheet provided with a forsterite layer after finish annealing, wherein microareas of the forsterite layer are locally permeated in said sheet in a direction transverse to a rolling direction of said sheet into a surface of said steel sheet without fracture of said forsterite layer, said permeation being created by electron beam irradiation at an acceleration voltage of 65–500 kV and an acceleration current of 0.001–5 mA in a direction extending substantially perpendicular to the rolling direction of the steel sheet and said permeation has a diameter of about 0.005–0.3 mm and are arranged in intervals of 2–20 mm wherein said microareas are about 0.005–0.5 mm apart in said intervals.

2. A low iron loss grain oriented silicon steel sheet provided with a forsterite layer and an insulative layer formed thereon after finish annealing, wherein microareas of the forsterite layer and insulative layer are locally permeated in said sheet in a direction transverse to a rolling direction of said sheet into a surface of said steel sheet without fracture of said forsterite layer, or said insulative layer, said permeation being created by electron beam irradiation at an acceleration voltage of 65–500 kV and an acceleration current of 0.001–5 mA in a direction extending substantially perpendicular to the rolling direction of the steel sheet and said permeation has a diameter of about 0.005–0.3 mm and are arranged in intervals of 2–20 mm wherein said microareas are about 0.0005–0.5 mm apart in said intervals.

3. The lower iron loss grain oriented silicon steel sheet according to claim 1 or 2, wherein said microareas extend up to the rear surface of said sheet through base metal.

4. A low iron loss grain oriented silicon steel sheet having a front surface and a rear surface, said front surface being provided with a forsterite layer after finish annealing, wherein microareas of said forsterite layer are locally permeated by electron beam irradiation into the front surface of the steel sheet without fracture of said forsterite layer to form permeations that are arranged in a direction substantially across the rolling direction of the steel sheet, and wherein said permeations extend through said sheet to and including the rear surface of said sheet.

5. A low iron loss grain oriented silicon steel sheet having a front surface and a rear surface, said front surface being provided with a forsterite layer and an insulative layer formed thereon after finish annealing, wherein microareas of said forsterite layer and insulative layer are locally permeated by electron beam irradiation into the front surface of the steel sheet without fracture of said forsterite layer or said insulative layer to form permeation that are arranged in a direction substantially across the rolling direction of the steel sheet and wherein said permeation extend through said sheet to and including the rear surface of said sheet through base metal.

* * * * *

UNITED STATES PATENT AND TRADEMARK OFFICE

CERTIFICATE OF CORRECTION

PATENT NO. : 5,223,048

DATED : June 29, 1993

INVENTOR(S) : Yukio Inokuti

It is certified that error appears in the above-indentified patent and that said Letters Patent is hereby corrected as shown below:

Column 8, Table 3, under the column entitled "Magnetic Properties", third line, please remove "1.91" and "0.78" (second occurrence).

Signed and Sealed this

Nineteenth Day of April, 1994

*Attest:*

*Attesting Officer*

BRUCE LEHMAN

*Commissioner of Patents and Trademarks*